US007264443B2

(12) United States Patent
Rozario et al.

(10) Patent No.: US 7,264,443 B2
(45) Date of Patent: Sep. 4, 2007

(54) CENTRIFUGAL WATER PUMP

(75) Inventors: Frederick J. Rozario, Fenton, MI (US); Dennis Kitching, Clarkston, MI (US); William A. Berry, Davison, MI (US); Allen G. Sheppard, St. Catherines (CA)

(73) Assignee: General Motors Corporation, Detroit, MI (US)

( * ) Notice: Subject to any disclaimer, the term of this patent is extended or adjusted under 35 U.S.C. 154(b) by 177 days.

(21) Appl. No.: 11/040,617

(22) Filed: Jan. 21, 2005

(65) Prior Publication Data

US 2006/0165523 A1 Jul. 27, 2006

(51) Int. Cl.
*F04D 29/28* (2006.01)

(52) U.S. Cl. ..... 415/206; 416/185; 416/203

(58) Field of Classification Search ..... 415/204, 415/205, 206; 416/185, 203; 417/423.1
See application file for complete search history.

(56) References Cited

U.S. PATENT DOCUMENTS 3,130,679 A * 4/1964 Sence ..... 415/204
3,162,135 A * 12/1964 Nichols et al. ..... 415/196
3,260,216 A * 7/1966 Mann et al. ..... 415/206
3,295,456 A * 1/1967 Warren ..... 416/182
4,239,453 A * 12/1980 Hergt et al. ..... 415/208.1
5,605,444 A * 2/1997 Paton et al. ..... 416/183
2003/0175118 A1* 9/2003 Chujo et al. ..... 415/206

* cited by examiner

*Primary Examiner*—Edward K. Look
*Assistant Examiner*—Nathan Wiehe

(57) ABSTRACT

A pump includes a housing defining an internal chamber having an axial inlet passage, a generally radial passage with an outlet to a volute. A rotatable impeller, disposed within the chamber, has a conical rear shroud sloping away from the axial inlet to define a rear recess. A shaft seal is disposed within the recess to minimize the axial length of the pump. A front surface of the shroud carries vanes operable to impel fluid from the axial inlet passage to the volute. Portions of the vanes extend forward into the axial inlet passage to induce coolant pre-rotation in the inlet passage and to improve pump efficiency. Pump efficiency may be further increased by a conical wall defining the axial inlet passage, a sloped wall defining the radial passage and a large radius between the axial inlet and the sloped wall to smooth fluid flow between the axial inlet passage and the volute.

18 Claims, 4 Drawing Sheets

CENTRIFUGAL WATER PUMP

TECHNICAL FIELD

This invention relates to fluid pumps and, more particularly, to centrifugal coolant pumps for use with an internal combustion engines.

BACKGROUND OF THE INVENTION

Centrifugal-type automotive water pumps are known in the art for pumping coolant through internal combustion engines. However, improvements in performance and efficiency are desired.

SUMMARY OF THE INVENTION

The present invention includes design features that can provide a smaller water pump with improved flow performance.

The pump includes a housing defining an internal chamber having an axial inlet passage connecting with a generally radial passage having an outlet to a volute. A bearing supported shaft, rotatable on an axis, is carried in the housing. The shaft extends from the chamber axially through the housing and is connected with a drive member at an opposite end of the housing. An impeller is carried on the shaft within the chamber. The impeller has a conical rear shroud sloping away from the axial inlet.

A front surface of the shroud carries long and short vanes operable to impel fluid from the axial inlet to the volute. The long vanes extend forward into the axial inlet and induce coolant pre-rotation in the inlet to improve pump efficiency and reduce the likelihood of cavitation. The long vanes also extend outward to the outlet to impel fluid from the axial inlet to the volute. The short vanes extend to the outlet between and parallel with outer portions of the long vanes. The vanes are also curved backward, opposite the direction of impeller rotation, to maximize flow efficiency.

A shaft seal, sealingly engaging the shaft, is carried in the housing and received within a recessed rear portion of the conical shroud. The seal is thus nested within the profile of the impeller, thereby reducing the axial length of the pump.

The axial inlet passage is defined by a conical side wall, increasing in diameter from an inlet opening to a radius joining with a sloped (preferably conical) front wall. The sloped front wall is spaced adjacent front surfaces of the impeller vanes and slopes rearward toward the outlet, generally parallel to the slope of the impeller. The combination of the conical side wall having a radius joining with the sloped front wall reduces coolant turbulence and the likelihood of coolant flow separation at high speeds and flows to inhibit cavitation. The reduction in turbulence also improves efficiency.

These and other features and advantages of the invention will be more fully understood from the following description of certain specific embodiments of the invention taken together with the accompanying drawings.

DESCRIPTION OF THE PREFERRED EMBODIMENT

Figure 1:
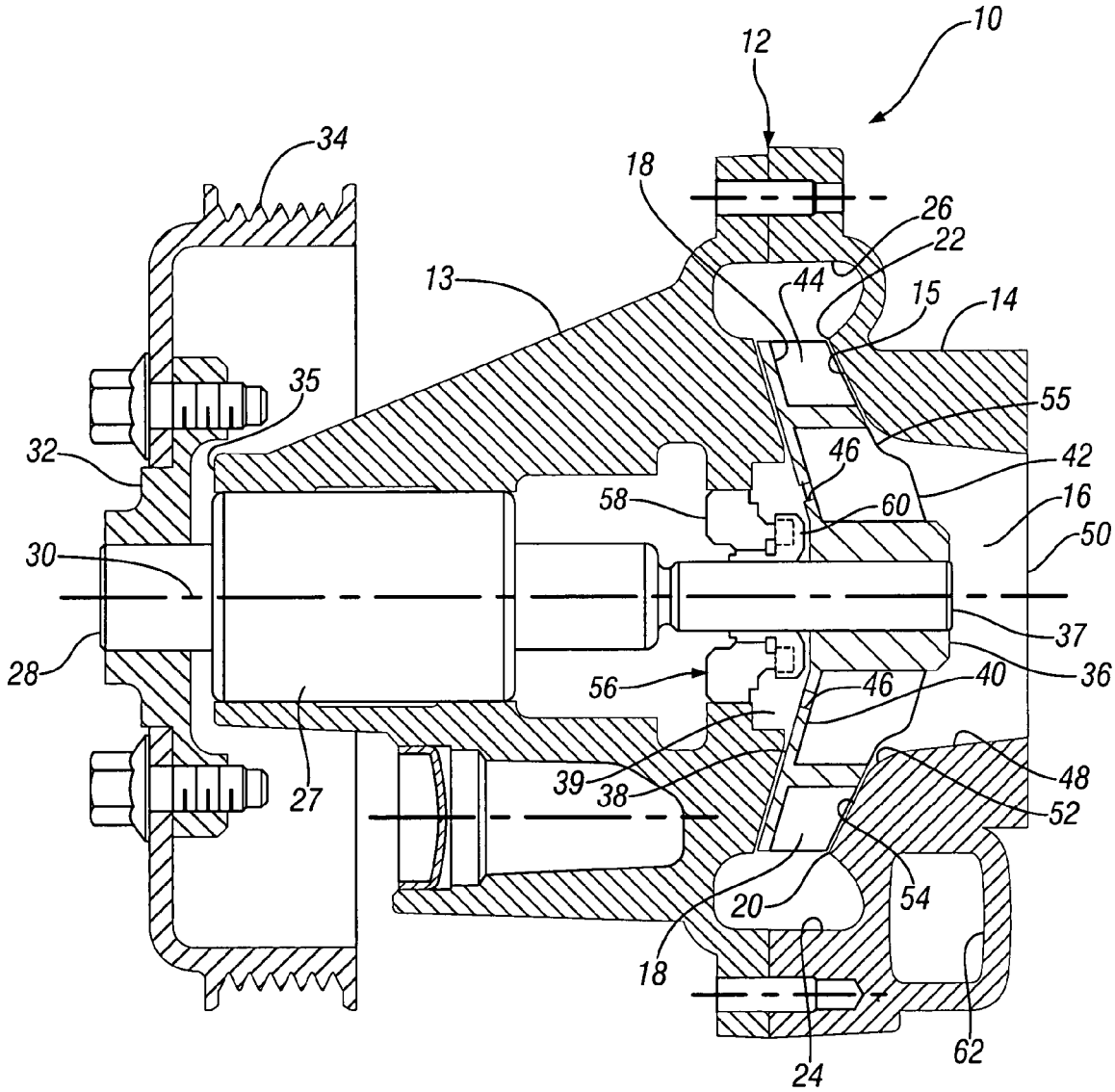
FIG. 1 is an axial vertical cross-sectional view through a water pump according to the present invention.
Figure 2:
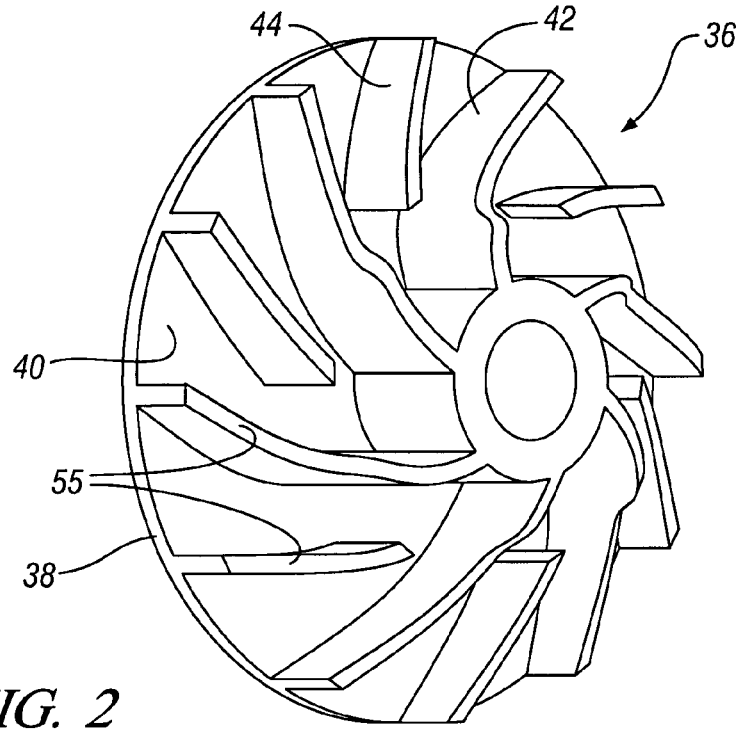
FIG. 2 is a pictorial view of the water pump impeller.

Referring first to FIGS. 1 and 2 of the drawings in detail, numeral 10 generally indicates a centrifugal water pump according to the invention for use with an automotive internal combustion engine. The pump 10 includes a housing 12 including a drive body 13 and an inlet cover 14. The housing 12 defines an internal pumping chamber 15 having an axial inlet passage 16 and a generally radial passage 18 with outlets 20, 22 connecting with a pair of volutes 24, 26. A bearing 27 supports a shaft 28, which is rotatable on an axis 30 and carried in the drive body 13 of the housing 12. The shaft 28 extends axially through the drive body 13 of the housing and mounts a flange 32 with a drive member, such as pulley 34, adjacent an outer end 35 of the housing 12. An impeller 36 is disposed in the chamber 14 and carried on an inner end 37 of the shaft 28.

As shown in FIGS. 1 and 2, the impeller 36 has a conical rear shroud 38 sloping away from the axial inlet passage 16 to define a rear recess 39. A front surface 40 of the shroud 38 carries curved long and short vanes 42, 44 operable to impel fluid from the axial inlet passage 16 to the volutes 24, 26. The long vanes 42 extend forward into the axial inlet passage 16 and induce coolant pre-rotation in the axial inlet to improve pump efficiency and reduce the likelihood of cavitation. The long vanes 42 also extend outward in the radial passage 18 to the outlets 20, 22 to impel fluid from the axial inlet 16 to the volutes 24, 26. The short vanes 44 extend outward to the outlets 20, 22 to aid efficient pumping of the fluid to the volutes 24, 26.

The vanes 42, 44 illustrated in FIG. 2 are shown as being curved. However, the vanes 42, 44 could alternatively be straight or be formed by grooves in the surface of the shroud.

If desired, the shroud of the impeller may have pressure balancing holes 46 that extend through the shroud to equalize fluid pressures adjacent the front surface 40 and the rear recess 39 of the impeller 36.

The axial inlet passage 16 is defined by a conical wall 48 of the housing 12, increasing in diameter from an inlet opening 50 to a radius 52, joining wall 48 with a sloped front wall 54 of the housing 12. The sloped front wall 54 is spaced adjacent front edges 55 of the vanes 42, 44 of the impeller 36. The front wall 54 slopes rearward, away from the inlet opening 50, to the outlets 22, 24 and generally parallel to the slope of the impeller 36. The combination of the conical wall 48 and the radius 52 joining with the sloped front wall 54 reduces turbulence and the likelihood of coolant flow separation at high speeds and flows, to inhibit pump cavitation. This reduction in turbulence also improves the efficiency of the pump 10.

A shaft seal 56 is carried in the housing 12 adjacent the shroud 38 of the impeller 36 to sealingly engage the shaft 28. The seal includes a support ring 58 pressed into a bore of the drive body 13 and a lip seal 60 carried by the ring 58 and engaging the shaft 28 to control coolant leakage. The lip seal 60 is positioned within the rear recess 39 of the shroud 38 to minimize the axial length of the pump 10 by carrying the seal lip within the profile of the impeller.

In operation, a chain or accessory belt, not shown, is connected to the drive member 34 to rotate the shaft 28 and the impeller 36 and operate the pump 10. Alternatively, the shaft 28 may be directly driven by a gear or motor, not shown, engaging the drive member 34.

As the impeller 36 is rotated within the housing 12, fluid is drawn into a center portion of the rotating impeller 36 from the inlet opening 50 and the axial inlet passage 16. The increasing diameter of the conical wall 48 reduces the velocity of fluid flow from the inlet opening 50 to the vanes 42 of the impeller 36. The long vanes 42 of the impeller 36 extend into the axial inlet passage 16 to pre-rotate fluid within the axial inlet passage. This causes the fluid to swirl in the same direction as the rotation of the impeller and reduce the likelihood of cavitaion when the impeller increases in speed.

As the impeller 36 rotates, it generates centrifugal force which pumps the fluid through the outlets 20, 22 to the volutes 24, 26. Fluid entering the inlet 50 is slowed by the increasing diameter of the conical wall 48 and is prerotated and drawn in by the long vanes 42. The large radius and shallow angle smooth flow along the sloped front wall, reducing turbulence and thereby increasing pump efficiency and the likelihood of cavitation.

In the embodiment of FIGS. 1 and 2, the pump 10 is designed for a relatively high coolant flow automotive engine application. The vanes 42, 44 are curved backward for efficient fluid flow as the impeller 36 is rotated in a counterclockwise direction as viewed from the inner end (or front side) of the impeller as shown in FIG. 2. The application requires that the two volutes deliver coolant through separate outlets on the same side of the housing. Thus, volute 24 feeds directly an outlet, not shown, while volute 22 connects through a passage 62 in the inlet cover with a separate outlet, not shown, both outlets being located on the far side of the housing as shown in FIG. 1.

Figure 3:
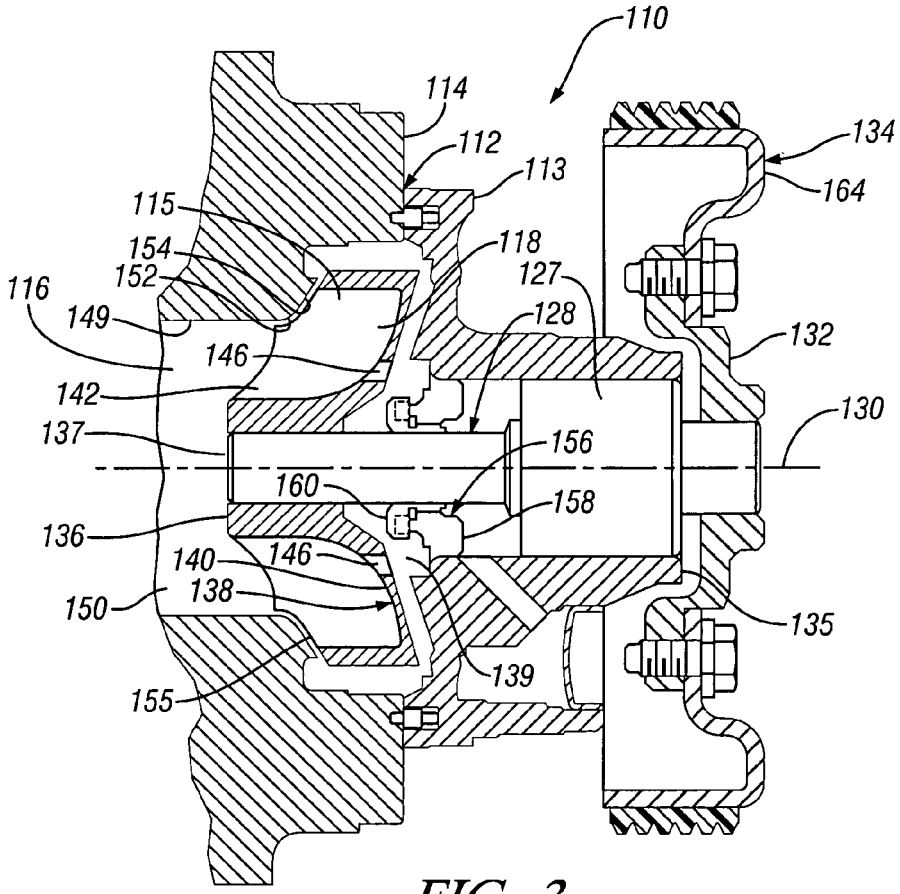
FIG. 3 is a view similar to FIG. 1 showing an alternative embodiment of a pump mounted on an engine front wall.
Figure 4:
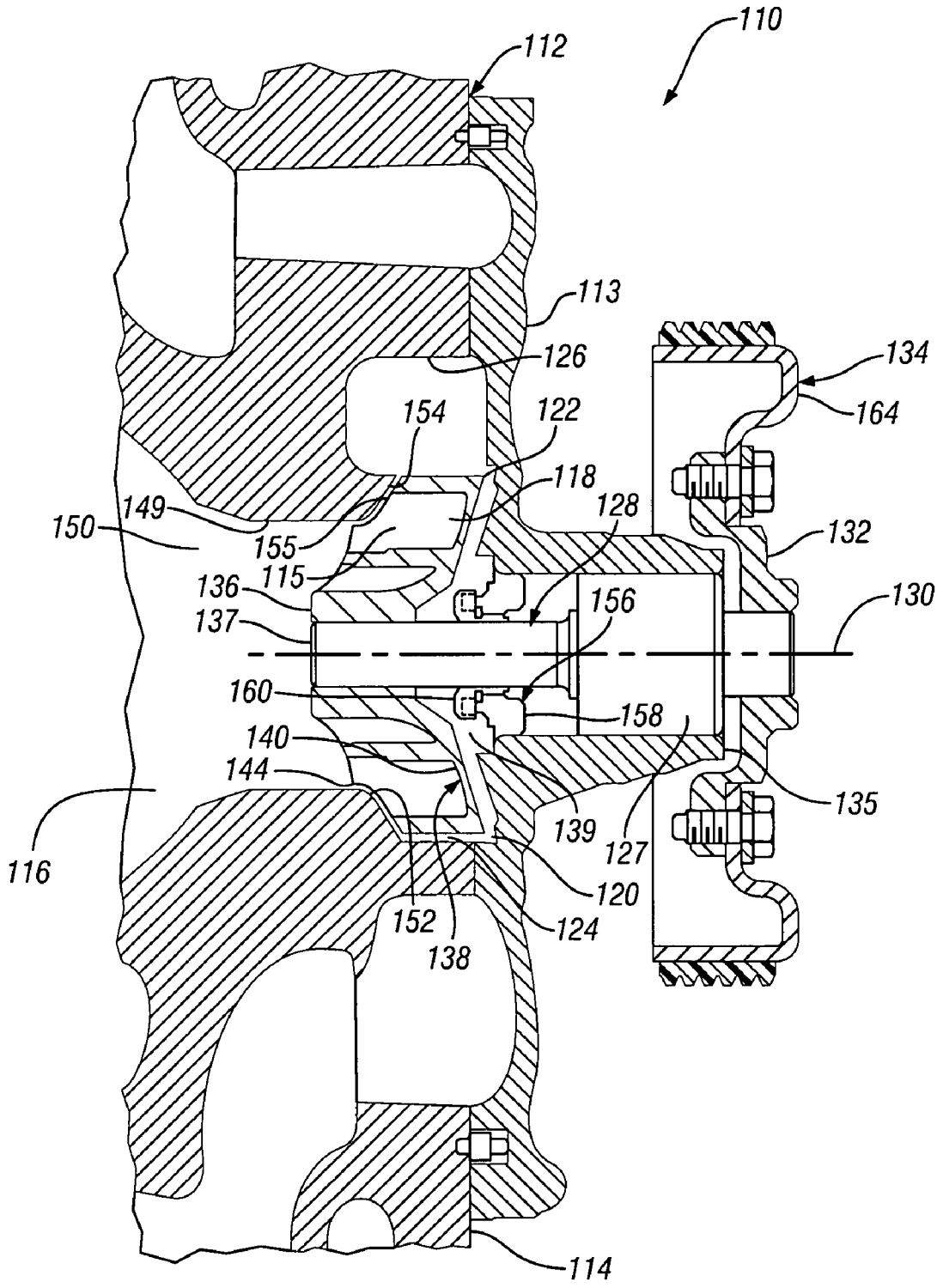
FIG. 4 is an axial horizontal cross-sectional view of the pump of FIG. 3.
Figure 5:
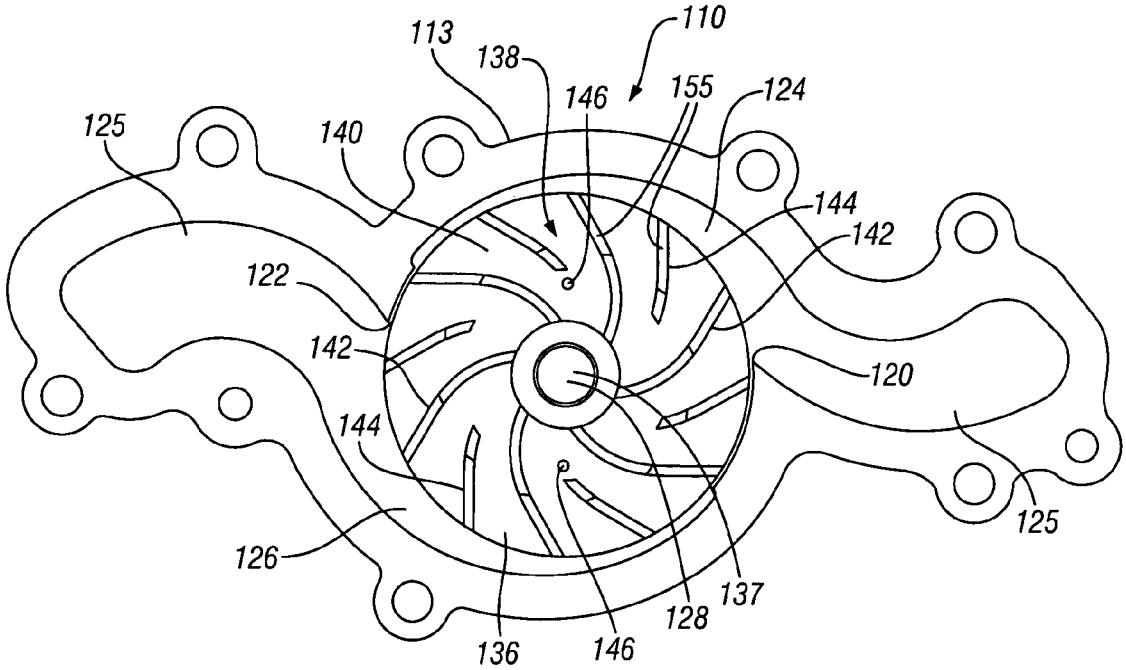
FIG. 5 is an inner end view showing the pump of FIGS. 3 and 4 prior to mounting on the engine.

Referring now to FIGS. 3-5, there is shown an alternative embodiment of centrifugal water pump generally indicated by numeral 110 and formed according to the invention. Pump 110 includes the basic features of the invention packaged in a different manner to meet the requirements of a differing application in which clearance for mounting of the pump is limited and pumping of a lesser volume of coolant is required. To bring out the similarities and differences, the following description will generally follow that of the pump 10 but with the components having the same or similar configurations or functions identified by like reference numerals in the 100 series.

As shown in FIGS. 3-5, centrifugal water pump 110 includes a housing 112 made up of a drive body 113 that is attached to inlet cover 114 formed as part of the front wall of an associated engine. The housing 112 defines an internal pumping chamber 115 having an axial inlet passage 116 and a generally radial passage 118 with outlets 120, 122 connecting with a pair of volutes 124, 126. The chamber 115, passages 116, 118, outlets 120, 122 and volutes 124, 126 are formed by mating recesses in the engine front wall (inlet cover 114) and the drive body 113. The volutes 124, 126 connect with separate passages 125, formed partially in the drive body 113, that connect the pump with cooling passages of the engine.

A bearing 127 supports a shaft 128, rotatable on an axis 130, and carried in the drive body 113 of the housing 12. The shaft 128 extends axially through the drive body 113 of the housing and mounts a flange 132 with a drive member, such as pulley 134, adjacent an outer end 135 of the housing 112. An impeller 136 is disposed in the chamber 114 and carried on an inner end 137 of the shaft 128.

As shown in FIGS. 3-5, the impeller 136 has a conical rear shroud 138 sloping away from the axial inlet passage 116 to define a rear recess 139. A front surface 140 of the shroud 138 carries curved long and short vanes 142, 144 operable to impel fluid from the axial inlet 116 to the volutes 124, 126. The long vanes 142 extend forward into the axial inlet passage 116 and induce coolant pre-rotation in the axial inlet passage to improve pump efficiency and reduce the likelihood of cavitation. The long vanes 142 also extend outward into the radial passage 118 to the outlets 120, 122 to impel fluid from the axial inlet passage 116 to the volutes 124, 126. The short vanes 144 extend outward to the outlets 120, 122 to aid efficient pumping of the fluid to the volutes 124, 126.

The vanes 142, 144 illustrated in FIG. 5 are shown as being curved. However, they could be straight or be formed by grooves in the surface of the shroud within the scope of the invention. The short vanes could also have portions extending into the axial inlet passage. Alternatively, vanes all of equal length could be used on the impeller.

The shroud of the impeller may be provided with pressure balancing holes 146 that extend axially through the shroud to equalize fluid pressure adjacent the front surface 140 and the rear recess 139 of the impeller 136.

The axial inlet passage 116 is defined by a generally cylindrical wall 149. The passage is made large enough to limit coolant flow to a value low enough to prevent cavitation in the inlet. The passage 116 is joined by a radius 152 with a sloped front wall 154 of the housing 112. The sloped front wall 154 is spaced adjacent front edges 155 of the vanes 142, 144 of the impeller 136. The front wall 154 slopes rearward, away from the inlet passage 116, to the outlets 122, 124 and generally parallel to the slope of the impeller 136. The combination of the large inlet passage 116 with cylindrical wall 149 and the radius 152 joining with the sloped front wall 154 is configured to reduce turbulence and the likelihood of coolant flow separation at high speeds and flows and to inhibit pump cavitation. This reduction in turbulence also improves the efficiency of the pump 110.

A shaft seal 156 is carried in the housing 112 adjacent the shroud 138 of the impeller 136 to sealingly engage the shaft 128. The seal includes a support ring 158 pressed into a bore of the drive body 113 and a lip seal 160 carried by the ring and engaging the shaft 128 to control coolant leakage. The lip seal 60 is positioned within the rear recess 139 of the shroud 138 to minimize the axial length of the pump 110 by carrying the seal lip within the profile of the impeller. Pump length beyond the front wall of the engine is further reduced by using the front wall as the housing inlet cover 114. In this way, the protrusion of the pump is minimized by including only the axial length of the drive body 113 and the protrusion of the shaft 128 beyond the outer end 135 of the housing 112. Alignment of an outer end 164 of the pulley 134 with the shaft end minimizes shaft protrusion by providing for the drive belt, not shown, to align laterally as close as possible with the shaft end.

Operation of the pump 110 is generally similar to that of pump 10. However, pump 110 is more compact, has a lower flow rate than the larger unit and is integrated into the engine front wall (inlet cover 114), so that some of the features are altered to suit the application. In this instance, the vanes 142, 144 are curved backward for efficient fluid flow as the impeller 36 is rotated in a clockwise direction as viewed from the inner end (or front side) of the impeller as shown in FIG. 5. The two volutes 124, 126 deliver coolant to the separate passages 125 on opposite sides of the housing leading to the engine coolant jackets, not shown. Operation of the impeller vanes in the back sloping radial passage 118 and functioning of the shaft seal 156 within the rear recess 139 remain the same as in pump 10.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A centrifugal coolant pump comprising:

a housing defining an internal chamber having an axial inlet passage connecting with a generally radial passage having an outlet to a volute;

a bearing supported shaft rotatable on an axis and carried in the housing, the shaft extending from the chamber to a drive member at an opposite end of the housing; and an impeller disposed in the chamber and carried on the shaft;

the impeller having a conical rear shroud sloping away from the inlet relative to a plane perpendicular to the shaft axis, the shroud carrying a plurality of generally radial vanes operable to impel fluid from the axial inlet to the volute, wherein the vanes include long vanes extending forward into the axial inlet passage to induce coolant pre-rotation in the inlet passage.

2. A pump as in claim 1 including a shaft seal axially adjacent the shroud and sealingly engaging the shaft.

3. A pump as in claim 2 wherein the shaft seal is received within a recessed rear portion of the conical shroud.

4. A pump as in claim 1 wherein the radial passage is defined by a sloped front wall opposite the shroud and sloping rearward to the outlet.

5. A pump as in claim 4 wherein the inlet passage is defined as an axially extending conical wall of increasing diameter from an inlet opening to a radius joining with the conical front wall.

6. A pump as in claim 5 wherein the radius is sufficiently large to avoid coolant flow separation at high speeds and flows to inhibit cavitation.

7. A pump as in claim 6 wherein the long vanes also extend outward to the outlet.

8. A pump as in claim 6 including additional short vanes extending generally radially outward from the inlet to the outlet.

9. A pump as in claim 1 wherein the vanes are curved opposite the direction of impeller rotation to maximize flow efficiency.

10. A centrifugal coolant pump comprising:

a housing defining an internal chamber having an axial inlet passage connecting with a generally radial passage having an outlet to a volute;

a bearing supported shaft rotatable on an axis and carried in the housing, the shaft extending from the chamber to a drive member at an opposite end of the housing; and an impeller disposed in the chamber and carried on the shaft, the impeller having a conical rear shroud sloping away from the inlet relative to a plane perpendicular to the shaft axis, the shroud carrying a plurality of first vanes that extend generally radially, the first vanes operable to impel fluid from the axial inlet to the volute, wherein an at least one vane extends forward into the axial inlet passage to induce coolant pre-rotation in the inlet passage.

11. A pump as in claim 10 including a shaft seal axially adjacent the shroud and sealingly engaging the shaft.

12. A pump as in claim 11 wherein the shaft seal is received within a recessed rear portion of the conical shroud.

13. A pump as in claim 10 wherein the radial passage is defined by a sloped front wall opposite the shroud and sloping rearward to the outlet.

14. A pump as in claim 13 wherein the inlet passage is defined as an axially extending conical wall of increasing diameter from an inlet opening to a radius joining with the conical front wall.

15. A pump as in claim 14 wherein the radius is sufficiently large to avoid coolant flow separation at high speeds and flows to inhibit cavitation.

16. A pump as in claim 10 wherein the first vanes extend generally radially outward from the inlet to the outlet.

17. A pump as in claim 16 wherein the plurality of vanes include second vanes that extend generally radially outward to the outlet.

18. A pump as in claim 17 wherein the second vanes have a radial length less than a radial length of the first vanes.

* * * * *